US011081829B2

(12) United States Patent
Ikeya

(10) Patent No.: US 11,081,829 B2
(45) Date of Patent: Aug. 3, 2021

(54) CONNECTOR

(71) Applicant: YAZAKI CORPORATION, Tokyo (JP)

(72) Inventor: Kazuhide Ikeya, Makinohara (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 16/589,044

(22) Filed: Sep. 30, 2019

(65) Prior Publication Data

US 2020/0144760 A1 May 7, 2020

(30) Foreign Application Priority Data

Nov. 2, 2018 (JP) ..... JP2018-207312

(51) Int. Cl.
*H01R 13/52* (2006.01)
*H01R 13/627* (2006.01)

(52) U.S. Cl.
CPC ..... *H01R 13/52* (2013.01); *H01R 13/627* (2013.01)

(58) Field of Classification Search
CPC ..... H01R 13/627; H01R 13/52
See application file for complete search history.

(56) References Cited

U.S. PATENT DOCUMENTS 5,266,045 A 11/1993 Yamamoto et al.
5,613,868 A * 3/1997 Ohsumi ..... H01R 13/5221 439/275
6,217,394 B1 * 4/2001 Sugie ..... H01R 13/5208 439/587
7,044,762 B1 * 5/2006 Hong ..... H01R 13/5213 439/275
7,086,899 B1 * 8/2006 Miyakawa ..... H01R 13/506 439/475
7,465,185 B2 * 12/2008 Tyler ..... H01R 13/506 439/352
7,517,246 B2 * 4/2009 Miyakawa ..... H01R 43/005 439/260

(Continued)

FOREIGN PATENT DOCUMENTS

JP H5-38780 U 5/1993
JP 2003-346969 A 12/2003

(Continued)

*Primary Examiner* — Briggitte R. Hammond
(74) *Attorney, Agent, or Firm* — Kenealy Vaidya LLP

(57) ABSTRACT

A connector includes a housing including a terminal accommodating chamber to accommodate a terminal, and a tubular portion to surround an insertion opening, through which the terminal enters the terminal accommodating chamber, the tubular portion including an opening portion, a water stop member to prevent water from passing through the insertion opening and a holding member to be inserted from the opening portion such that the water stop member is placed between the insertion opening and the holding member, the holding member retaining the water stop member inside the tubular portion. The holding member includes a projection on an outer surface of the holding member toward an inner peripheral surface of the tubular portion at an end portion of the holding member, the end portion is close to the opening portion of the tubular portion when the holding member is fitted in the tubular portion.

8 Claims, 7 Drawing Sheets

(56) References Cited

U.S. PATENT DOCUMENTS

| | | | | |
|---|---|---|---|---|
| 2002/0086575 | A1* | 7/2002 | Marpoe, Jr. ..... | H01R 13/64<br>439/352 |
| 2018/0026391 | A1 | 1/2018 | Kida | |

FOREIGN PATENT DOCUMENTS

| | | | |
|---|---|---|---|
| JP | 2009-48929 | A | 3/2009 |
| JP | 2018-18583 | A | 2/2018 |

* cited by examiner

CONNECTOR

CROSS-REFERENCE TO RELATED APPLICATION

The present application claims priority to Japanese Patent Application No. 2018-207312 filed on Nov. 2, 2018, the entire content of which is incorporated herein by reference.

TECHNICAL FIELD

The present invention relates to a connector including a water stop member configured to prevent water from entering a terminal accommodating chamber and a holding member for holding the water stop member.

BACKGROUND

A related art connector includes a housing having a terminal accommodating chamber in which a terminal connected to an end portion of an electric wire is accommodated, a water stop member provided behind the housing for sealing a gap between an electric wire and the housing, and a holding member for retaining the water stop member in the housing (see, e.g., JP2018-018583A).

However, in the related art connector described above, when a strong external force is applied to the electric wire connected to the connector, there is a possibility that displacement of the holding member and the water stop member occurs, and the water stopping performance of the water stop member decreases. It is desirable to prevent such deterioration in water stopping performance as much as possible.

SUMMARY

Illustrative aspects of the present invention provide a connector capable of maintaining excellent water stopping performance by a water stop member.

According to an illustrative aspect of the invention, a connector includes a housing including a terminal accommodating chamber configured to accommodate a terminal connected to an end of an electric wire, and a tubular portion provided so as to a surround an insertion opening, through which the terminal enters the terminal accommodating chamber, the tubular portion including an opening portion, a water stop member configured to be inserted from the opening portion of the tubular portion, the water stop member configured to prevent water from passing through the insertion opening and a holding member configured to be inserted from the opening portion such that the water stop member is placed between the insertion opening and the holding member, the holding member retaining the water stop member in position inside the tubular portion. The holding member includes a projection protruding from an outer surface of the holding member toward an inner peripheral surface of the tubular portion at an end portion of the holding member, the end portion being closer to the opening portion of the tubular portion than another end portion of the holding member is to the opening portion of the tubular portion when the holding member is fitted in the tubular portion.

Other aspects and advantages of the invention will be apparent from the following description, the drawings and the claims.

DESCRIPTION OF EMBODIMENTS

Figure 1A:
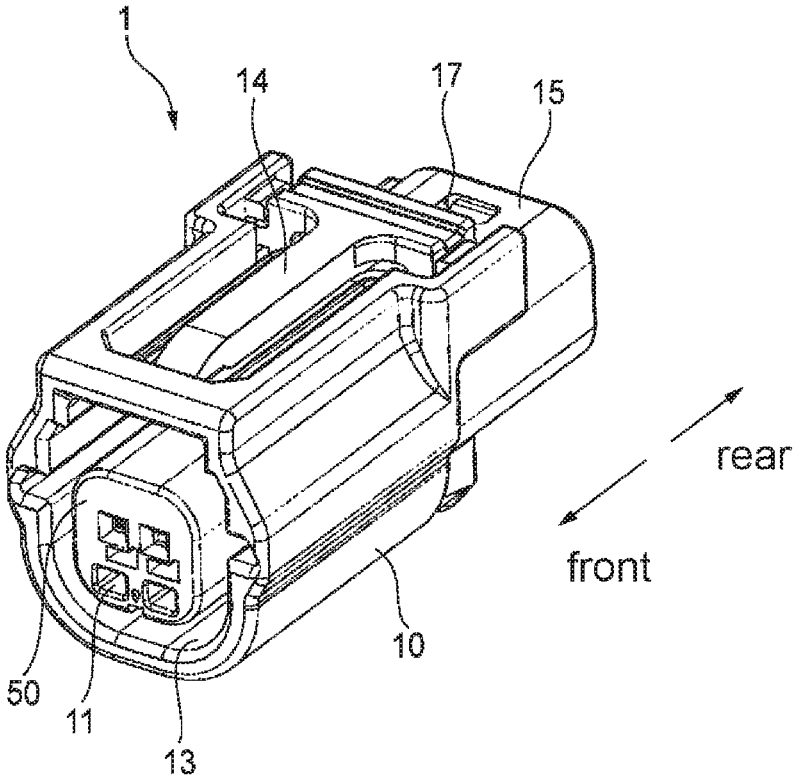
FIG. 1A is a front perspective view of a connector according to an embodiment of the present invention.
Figure 1B:
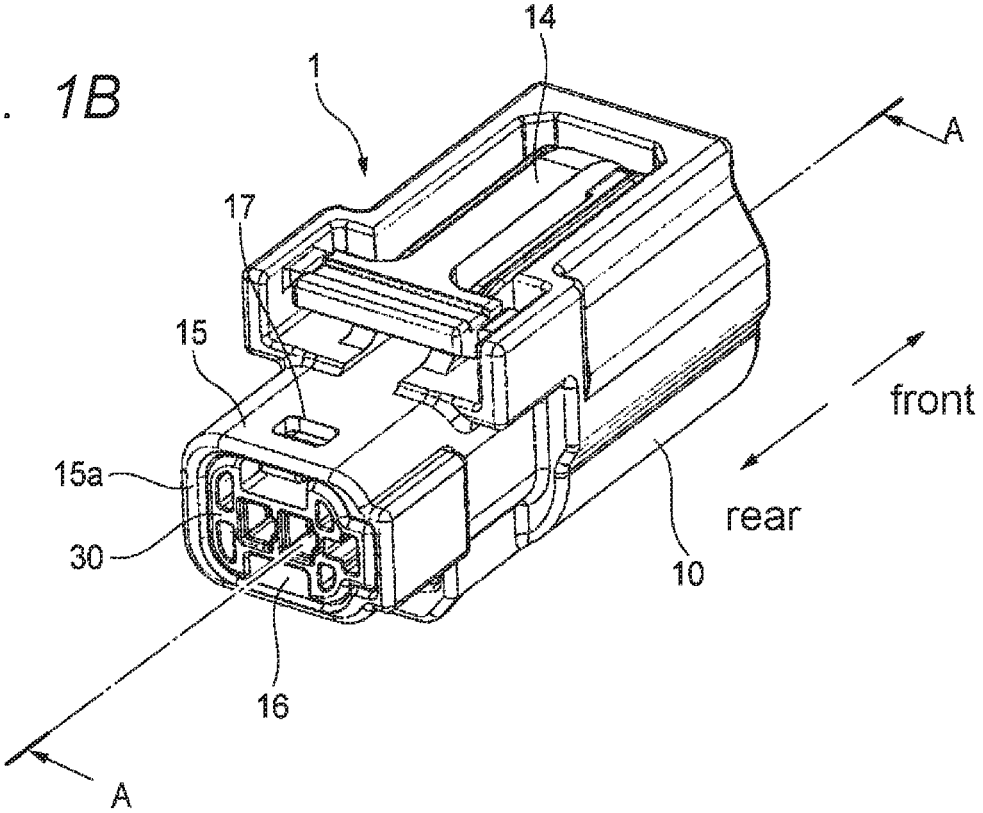
FIG. 1B is a rear perspective view of the connector.
Figure 4A:
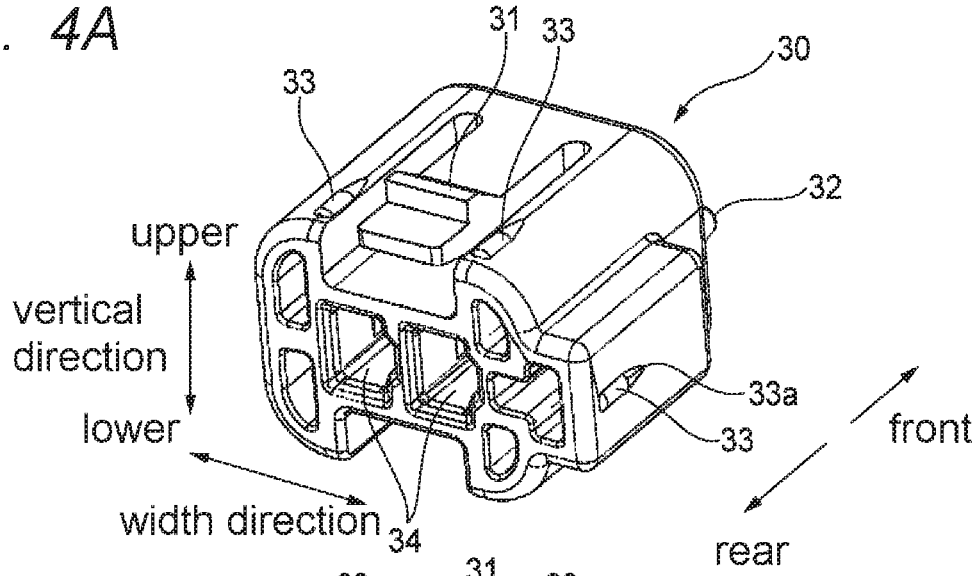
FIG. 4A is a perspective view of a mat seal cover included in the connector in FIGS. 1A to 1B.
Figure 4B:
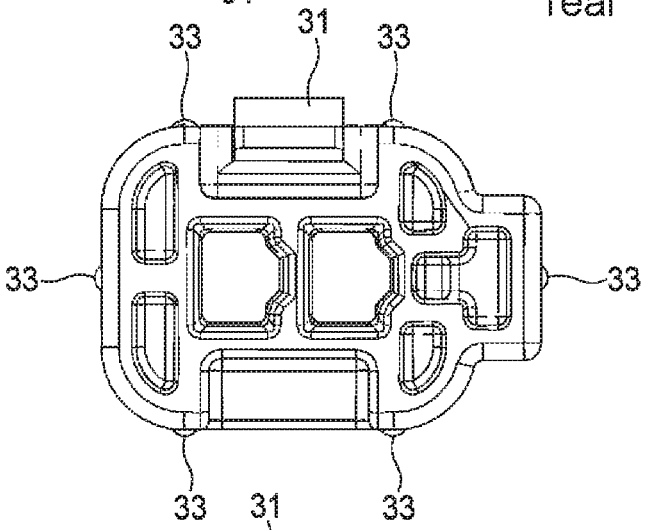
FIG. 4B is a rear view of the mat seal cover.
Figure 4C:
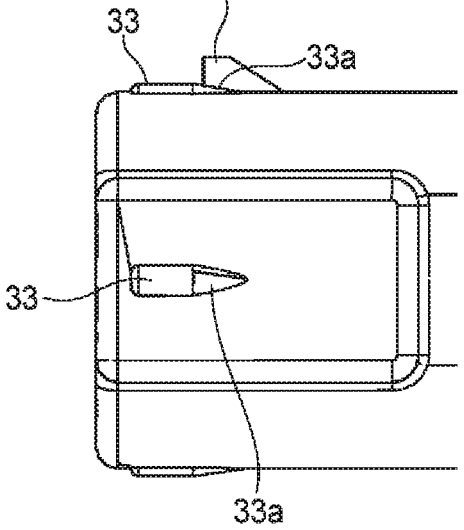
FIG. 4C is a side view of the mat seal cover.

Hereinafter, a connector 1 according to an embodiment of the present invention will be described with reference to the drawings. Hereinafter, for convenience of description, "front" and "back" are defined as shown in FIGS. 1A to 1B. The "vertical direction" and the "width direction" are defined as shown in FIGS. 4A to 4C. A front side of the connector 1 is configured to face a mating connector (not shown) and an electric wire W connected to a terminal (not shown) is to be drawn out from a rear side of the connector 1.

Figure 2:
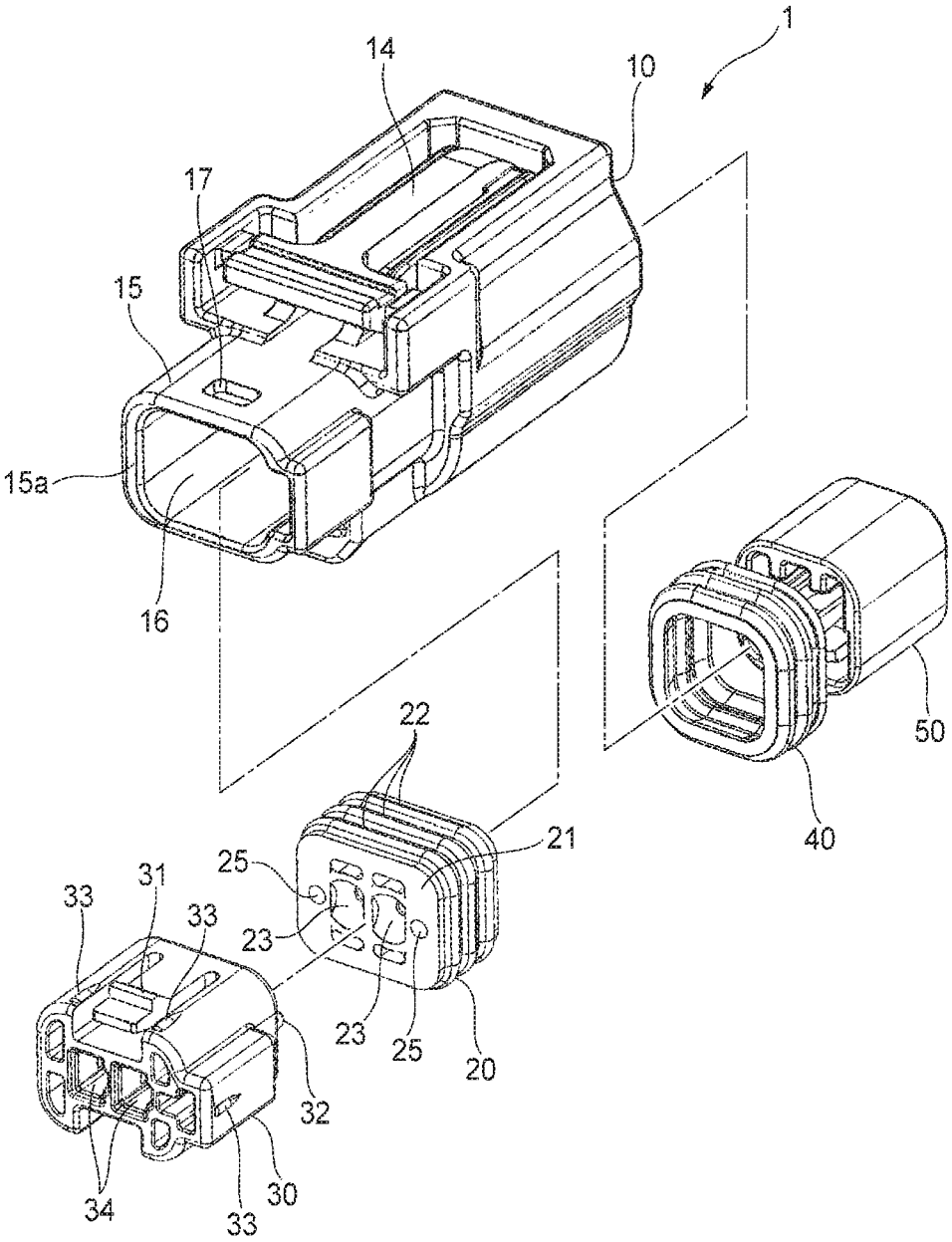
FIG. 2 is an exploded perspective view of the connector shown in FIGS. 1A to 1B.
Figure 3:
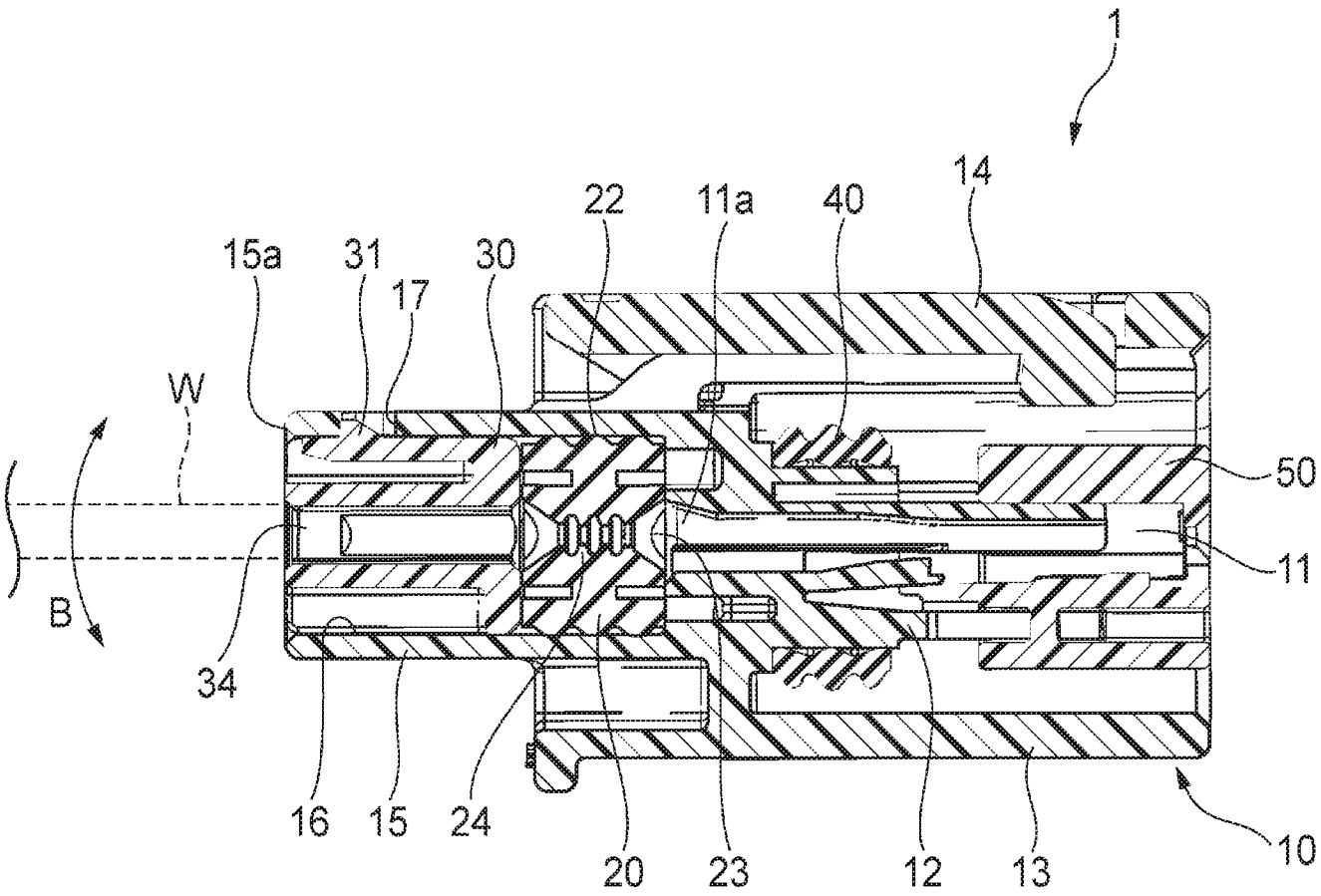
FIG. 3 is a cross-sectional view taken along line A-A of FIG. 1B.

As shown in FIGS. 1 to 3, the connector 1 includes a housing 10 made of resin, a mat seal 20 (water stop member) made of rubber or flexible resin configured to be attached to the housing 10 from a rear side of the housing 10, a mat seal cover 30 (holding member) made of resin configured to be attached to the housing 10 from a rear side of the housing 10 so as to press the mat seal 20 against the housing 10, a gasket 40 attached to the housing 10 from the front side of the housing 10, and a front holder 50 configured to be attached to the housing 10 from the front side of the housing 10. The connector 1 is a waterproof connector in which a gap between the electric wire W and the housing 10 is to be sealed by the mat seal 20.

More specifically, as shown in FIG. 3, the housing 10 includes a plurality of terminal accommodating chambers 11 for accommodating terminals (not shown), an inner housing 12 defining the terminal accommodating chambers 11, an outer housing 13 surrounding the inner housing 12 from outside, and a tubular portion 15 disposed on a rear side of the terminal accommodating chambers 11. The terminal accommodating chamber 11 is formed in a rectangular shape in front view. A terminal (not shown) of a rectangular tubular shape configured to be electrically connected to a mating terminal (not shown) is to be accommodated in the terminal accommodating chamber 11 from the rear side through an insertion opening 11*a* in a predetermined posture.

A housing including a mating connector (not shown) is to be inserted into a space between the inner housing 12 and the outer housing 13. At this time, the lock arm 14 provided on the outer housing 13 is engaged with a predetermined portion of the housing including the mating connector, thereby making the connector 1 and the mating connector being fitted to each other.

An end potion on the rear side of the outer housing 13 is connected to an end portion on the rear side of the inner housing 12 and an end portion on the front side of the tubular portion 15. The tubular portion 15 defines an accommodating space 16 for accommodating the mat seal 20 and the mat seal cover 30. As shown in FIG. 2, the mat seal 20 and the mat seal cover 30 are to be inserted into the accommodating space 16 so that the mat seal 20 and the mat seal cover 30 are attached thereto.

More specifically, as shown in FIG. 2, the mat seal 20 includes a lip portion 22 that seals a gap between the outer periphery of the mat seal 20 and the inner peripheral surface of the tubular portion 15 when a mat main body 21 is inserted into the accommodating space 16 of the tubular portion 15 from the rear side of the housing 10. Insertion holes 23 are formed in the mat seal 20 at positions of the mat main body 21 corresponding to the terminal accommodating chambers 11 of the housing 10, respectively. As shown in FIG. 3, a plurality of protrusions 24 are provided on an inner peripheral surface of the insertion hole 23. When the electric wire W is disposed so as to pass through the insertion hole 23, the protrusions 24 on the inner peripheral surface of the insertion hole 23 contact the outer peripheral surface of the electric wire W tightly. Further, when the mat seal 20 is inserted into the accommodating space 16, the lip portion 22 is brought into contact with the inner peripheral surface of the tubular portion 15 in a pressed manner. As a result, the gap between the outer peripheral surface of the electric wire W and the mat seal 20 and the gap between the inner peripheral surface of the tubular portion 15 and the mat seal 20 are sealed, and intrusion of water or the like from the rear side of the housing 10 to the terminal accommodating chambers 11 is to be prevented.

The mat seal cover 30 is to be inserted into the accommodating space 16 of the tubular portion 15 from the rear side of the housing 10, and is to be fixed to the tubular portion 15 in a state where the mat seal 20 is sandwiched between the mat seal cover 30 and the terminal accommodating chambers 11. Specifically, the mat seal cover 30 includes a locking projection 31 protruding toward the inner peripheral surface of the tubular portion 15. The locking projection 31 is to be engaged with a locking hole 17 formed in the tubular portion 15 of the housing 10. The mat seal cover 30 is to be fixed to the tubular portion 15 since the locking projection 31 is engaged with the locking hole 17, thereby retaining the position of the mat seal 20 while pushing the mat seal 20 toward inside the tubular portion 15. Projections 33 (details will be described later) are provided on the outer surface of the mat seal cover 30.

The mat seal cover 30 includes lock portions 32 protruding from a surface facing the mat seal 20. The lock portions 32 are to be inserted into recessed portions 25 of the mat seal 20 to prevent the displacement of the mat seal 20. Further, the mat seal cover 30 is provided with through holes 34 at positions corresponding to the insertion holes 23 of the mat seal 20. As shown in FIG. 3, the electric wire W is to be directed to the terminal accommodating chamber 11 through the through hole 34 and the insertion hole 23 of the mat seal 20.

As shown in FIG. 4A to 4C, the mat seal cover 30 includes, at an end portion on the side close to the opening portion 15*a* of the tubular portion 15, projections 33 protruding from the outer surface thereof toward the inner peripheral surface of the tubular portion 15. In this example, two projections 33 are provided on the outer surface of the upper side of the mat seal cover 30, two projections 33 are provided on the outer surface of the lower side of the mat seal cover 30, and two projections 33 are provided on the outer side surfaces on both sides in the width direction. The projection 33 includes an inclined surface inclined so as to be away from the outer surface of the mat seal cover 30 toward the rear side of the mat seal cover 30 (see also FIG. 2) in an insertion direction in which the mat seal cover 30 is inserted into the tubular portion 15. When the mat seal cover 30 is inserted into the accommodating space 16 of the tubular portion 15, the projections 33 protrude from the outer surface by a height so that the projections 33 contact or contact in a pressed manner with the inner peripheral surface of the tubular portion 15.

Figure 5:
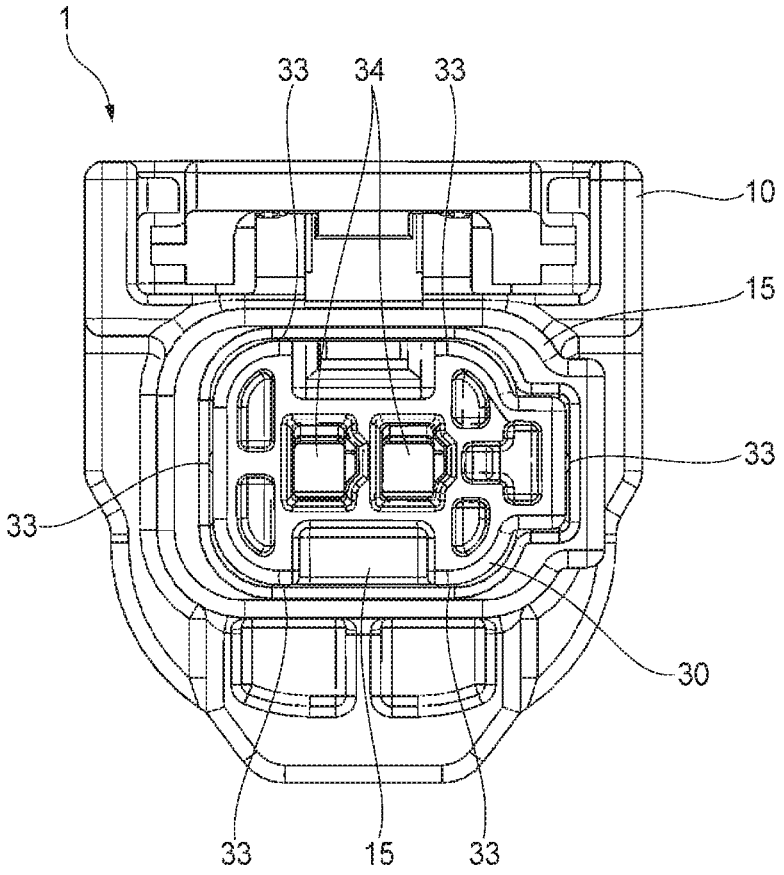
FIG. 5 is a rear view of the mat seal cover shown in FIG. 1B.

As shown in FIG. 5, when the mat seal cover 30 is inserted into the accommodating space 16 of the tubular portion 15 to be attached thereto, the projections 33 contact or contact in a pressed manner the inner peripheral surface of the tubular portion 15. As a result, the gap between the inner peripheral surface of the tubular portion 15 and the outer surface of the mat seal cover 30 is partially filled to eliminate a play between the tubular portion 15 and the mat seal cover 30. Further, since the projection 33 include the inclined surface 33*a* described above, when the projections 33 contact the opening portion 15*a* of the tubular portion 15 while the mat seal cover 30 is being attached to the tubular portion 15, the projections 33 can slide smoothly into the tubular portion 15 by the guiding effect provided by the inclined surfaces 33*a*.

As described above, according to the connector 1 according to the present embodiment, the projections 33 are provided on the outer surface of the mat seal cover 30. The projection 33 is disposed at an end portion of the mat seal cover 30 close to the opening portion 15*a* of the tubular portion 15 provided in the connector 1. The gap between the inner peripheral surface of the tubular portion 15 and the outer surface of the mat seal cover 30 is to be partially filled by the projections 33, thereby suppressing relative movement of the mat seal cover 30 with respect to the tubular portion 15.

In particular, when the electric wire W is deformed so as to be curved about the through hole 34 of the mat seal cover 30 as shown by an arrow B shown in FIG. 3, an external force due to the deformation is to be applied to the mat seal cover 30. Here, the mat seal cover 30 includes projections 33 at an end portion of the mat seal cover 30 close to the opening portion 15*a* of the tubular portion 15 that is susceptible to such an external force. Therefore, even when such an external force is applied, the displacement of the mat seal cover 30 is effectively prevented. Since the displacement of the mat seal cover 30 is prevented, the displacement of the mat seal 20 is also prevented. Therefore, the connector 1 can maintain excellent water stopping performance by the mat seal 20.

The projection 33 provided in the mat seal cover 30 includes an inclined surface 33*a*. As a result, direct contact between the opening portion 15*a* of the tubular portion 15 and the projections 33 without the inclined surface 33*a* is avoided and the workability of the operation of inserting (for example, the operation of fitting the mat seal cover into the tubular portion 15 in a pressed manner) the mat seal cover 30 into the cylindrical portion 15 is improved as compared with the case where the inclined surface 33*a* is not provided.

While the present invention has been described with reference to certain exemplary embodiments thereof, the scope of the present invention is not limited to the exemplary embodiments described above, and it will be understood by those skilled in the art that various changes and modifications may be made therein without departing from the scope of the present invention as defined by the appended claims.

Figure 6A:
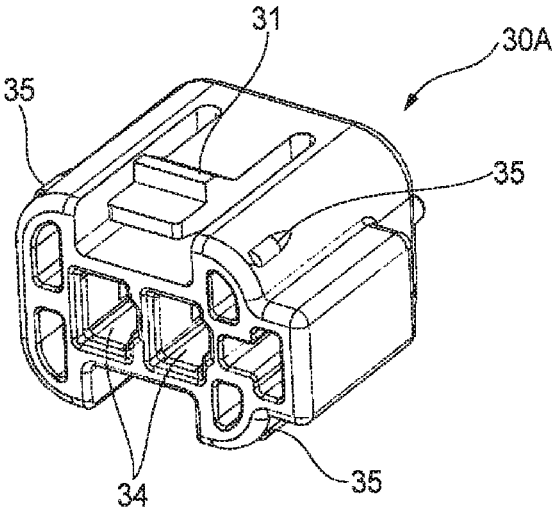
FIG. 6A is a perspective view of a mat seal cover included in a connector according to a modification of the present invention.
Figure 6B:
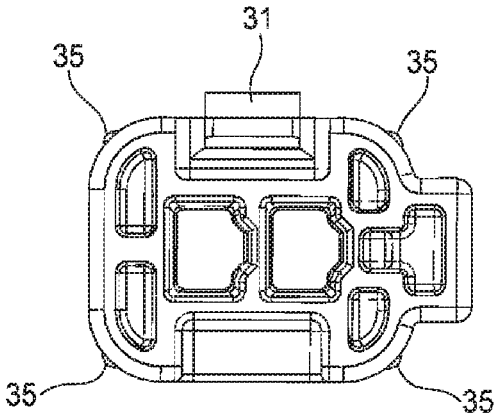
FIG. 6B is a rear view of the mat seal cover.
Figure 6C:
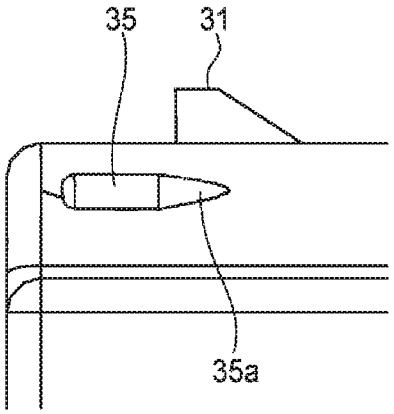
FIG. 6C is a side view of the mat seal cover.

For example, in the above embodiment, six projections 33 are provided on the outer surface of the mat seal cover 30. However, as long as the gap between the tubular portion 15 and the mat seal cover 30 can be partially filled with the projections 33 as described above, the number, arrangement, shape, or the like of the projections 33 are not particularly limited. As one example, as shown in FIGS. 6A to 6C, a mat seal cover 30A includes a projection 35 on at least one (four in FIGS. 6A to 6C) of corner portions in the peripheral direction of the outer surface of the mat seal cover 30 at the end portion on the side close to the opening portion 15*a* of the tubular portion 15. The projection 35 also includes an inclined surface 35*a* as described above. By disposing the projection 35 at the corner in this manner, the movement of the mat seal cover 30 can be effectively suppressed while reducing the number of the projections 35 as much as possible.

Figure 7A:
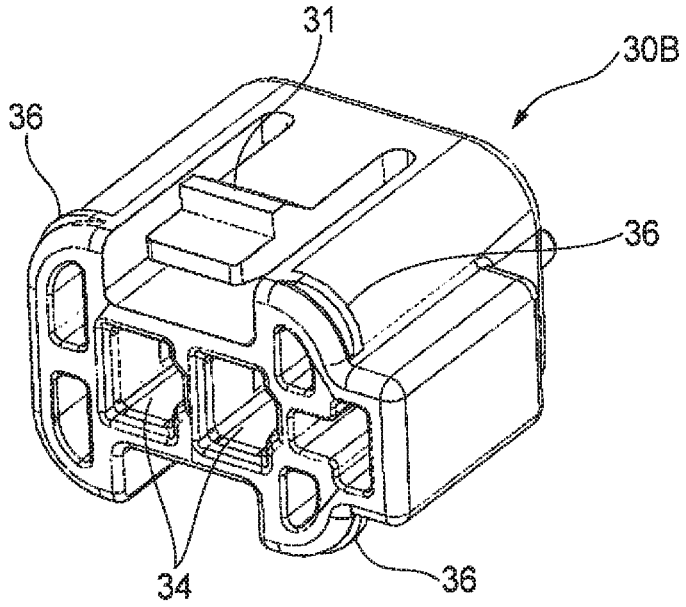
FIG. 7A is a perspective view of a mat seal cover included in a connector according to another modification of the present invention.
Figure 7B:
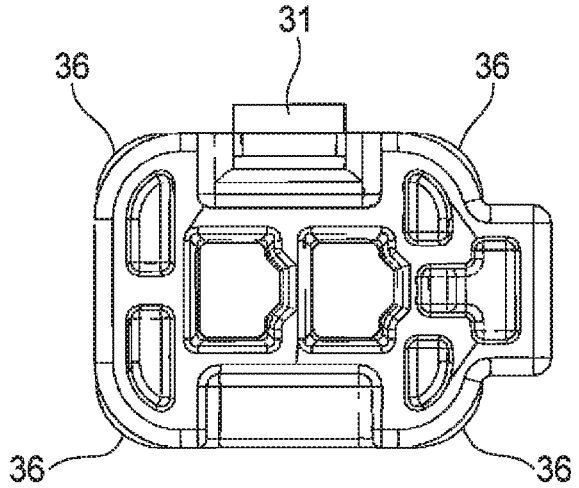
FIG. 7B is a rear view of the mat seal cover.
Figure 7C:
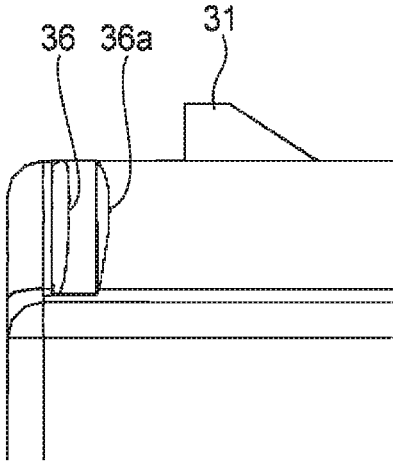
FIG. 7C is a side view of the mat seal cover.

As another example, as shown in FIGS. 7A to 7C, a mat seal cover 30B includes projections 36 extending in the peripheral direction of the mat seal cover 30B at the corner portions of the outer surface of the mat seal cover 30 in the peripheral direction at an end portion on the side close to the opening portion 15*a* of the tubular portion 15. The projection 36 also includes an inclined surface 36*a* as described above. By providing the projections 36 extending in the peripheral direction in this manner, the projections 36 and the inner peripheral surface of the tubular portion 15 are brought into contact with each other in a wide range in the peripheral direction of the mat seal cover 30. Therefore, the movement of the mat seal cover 30 can be effectively suppressed.

According to the exemplary embodiments described above, a connector (1) includes a housing (10) including a terminal accommodating chamber (11) configured to accommodate a terminal connected to an end of an electric wire (W), and a tubular portion (15) provided so as to a surround an insertion opening (11*a*), through which the terminal enters the terminal accommodating chamber (11), the tubular portion including an opening portion (15*a*), a water stop member (20) configured to be inserted from the opening portion (15*a*) of the tubular portion (15), the water stop member (20) configured to prevent water from passing through the insertion opening (11*a*) and a holding member (30) configured to be inserted from the opening portion (15*a*) such that the water stop member (20) is placed between the insertion opening (11*a*) and the holding member, the holding member (30) retaining the water stop member (20) in position inside the tubular portion (15). The holding member (30) includes a projection (33, 35, 36) protruding from an outer surface of the holding member (30) toward an inner peripheral surface of the tubular portion (15) at an end portion of the holding member (30), the end portion being closer to the opening portion (15*a*) of the tubular portion (15) than another end portion of the holding member (30) is to the opening portion (15*a*) of the tubular portion (15) when the holding member (30) is fitted in the tubular portion (15).

According to the connector having the above configuration, the projection is provided on the outer surface of the holding member. The projection is disposed at an end portion of the holding member and the end portion is to be disposed on the side close to the opening portion of the tubular portion provided in the connector when the holding member is fitted in the tubular portion. The gap between the inner peripheral surface of the tubular portion and the outer surface of the holding member is partially filled by the projection to eliminate a play between the tubular portion and the holding member, and relative movement of the holding member with respect to the tubular portion is suppressed. In particular, since the projection is provided on the end portion of the holding member on the side close to the opening portion of the tubular portion which is susceptible to the external force applied to the electric wire, the movement of the holding member is more effectively suppressed. Therefore, the connector of the present configuration can maintain excellent water stopping performance by the water stop member.

The projection (33, 35, 36) may include an inclined surface (33*a*, 35*a*, 36*a*) extending away from the outer surface of the holding member (30) in direction opposite to a direction in which the holding member (30) is to be inserted to the tubular portion (15).

According to the connector having the above configuration, the projection provided on the holding member includes an inclined surface. As a result, direct contact between the opening portion of the tubular portion and the projections without the inclined surface can be avoided and the workability of the operation of inserting (for example, the operation of fitting the mat seal cover into the tubular portion 15 in a pressed manner) the mat seal cover 30 into the cylindrical portion 15 is improved as compared with the case where the inclined surface 33*a* is not provided.

The holding member (30) may have a columnar shape corresponding to a shape of the inner peripheral surface of the tubular portion (15), and the projection (35) is provided on at least one corner portion of the holding member (30) in a peripheral direction of the holding member (30).

According to the connector having the above configuration, the projection is disposed on at least one of the corner portions of the holding member. Accordingly, the movement of the holding member can be effectively suppressed while reducing the number of the projections as much as possible.

The projection (36) may have a ridge shape extending in a peripheral direction of the holding member (30).

According to the connector having the above configuration, the projection has a ridge shape (e.g., like a rib) extending in the peripheral direction of the holding member. Thus, the projection and the inner peripheral surface of the tubular portion are brought into contact with each other in a wide range in the peripheral direction of the holding member. Therefore, the movement of the holding member in the diagonal direction with respect to an axis of the holding member can be more effectively suppressed.

What is claimed is:

1. A connector comprising:

a housing comprising a terminal accommodating chamber configured to accommodate a terminal connected to an end of an electric wire, and a tubular portion provided so as to surround an insertion opening, through which the terminal enters the terminal accommodating chamber, the tubular portion comprising an opening portion;

a water stop member configured to be inserted from the opening portion of the tubular portion, the water stop member configured to prevent water from passing through the insertion opening; and a holding member configured to be inserted from the opening portion such that the water stop member is placed between the insertion opening and the holding member, the holding member retaining the water stop member in position inside the tubular portion, wherein the holding member comprises a pair of projections protruding from an outer surface of the holding member toward an inner peripheral surface of the tubular portion at an end portion of the holding member, the end portion being closer to the opening portion of the tubular portion than another end portion of the holding member is to the opening portion of the tubular portion when the holding member is fitted in the tubular portion, wherein the pair of projections are configured to contact, when the holding member is fitted in the tubular portion, in a pressing manner with the inner peripheral surface of the tubular portion; and wherein the holding member comprises a locking projection, and the locking projection is located between the pair of projections.

2. The connector according to claim 1, wherein each of the pair of projections comprises an inclined surface extending away from the outer surface of the holding member in a direction opposite to a direction in which the holding member is to be inserted to the tubular portion.

3. A connector comprising:

a housing comprising a terminal accommodating chamber configured to accommodate a terminal connected to an end of an electric wire, and a tubular portion provided so as to surround an insertion opening, through which the terminal enters the terminal accommodating chamber, the tubular portion comprising an opening portion;

a water stop member configured to be inserted from the opening portion of the tubular portion, the water stop member configured to prevent water from passing through the insertion opening; and a holding member configured to be inserted from the opening portion such that the water stop member is placed between the insertion opening and the holding member, the holding member retaining the water stop member in position inside the tubular portion, wherein the holding member comprises a projection protruding from an outer surface of the holding member toward an inner peripheral surface of the tubular portion at an end portion of the holding member, the end portion being closer to the opening portion of the tubular portion than another end portion of the holding member is to the opening portion of the tubular portion when the holding member is fitted in the tubular portion, wherein the projection is configured to contact, when the holding member is fitted in the tubular portion, in a pressing manner with the inner peripheral surface of the tubular portion, and wherein the holding member has a columnar shape corresponding to a shape of the inner peripheral surface of the tubular portion, and the projection is provided on at least one corner portion of the holding member.

4. The connector according to claim 1, wherein each of the pair of projections has a ridge shape extending about a periphery of the holding member.

5. The connector according to claim 1, wherein each of the pair of projections contacts in a pressing manner with the inner peripheral surface of the tubular portion in an outward direction from the outer surface of the holding member.

6. The connector according to claim 1, wherein each of the pair of projections contacts the inner peripheral surface of the tubular portion in a vertical direction.

7. The connector according to claim 6, wherein the holding member includes a third projection that contacts the inner peripheral surface of the tubular portion in a width direction.

8. A connector comprising:

a housing comprising a terminal accommodating chamber configured to accommodate a terminal connected to an end of an electric wire, and a tubular portion provided so as to surround an insertion opening, through which the terminal enters the terminal accommodating chamber, the tubular portion comprising an opening portion;

a water stop member configured to be inserted from the opening portion of the tubular portion, the water stop member configured to prevent water from passing through the insertion opening; and a holding member configured to be inserted from the opening portion such that the water stop member is placed between the insertion opening and the holding member, the holding member retaining the water stop member in position inside the tubular portion, wherein the holding member comprises a projection protruding from an outer surface of the holding member toward an inner peripheral surface of the tubular portion at an end portion of the holding member, the end portion being closer to the opening portion of the tubular portion than another end portion of the holding member is to the opening portion of the tubular portion when the holding member is fitted in the tubular portion, wherein the projection is configured to contact, when the holding member is fitted in the tubular portion, in a pressing manner with the inner peripheral surface of the tubular portion, and wherein the projection contacts the inner peripheral surface of the tubular portion on an upper and a lower surface in a vertical direction and on opposing side surfaces in a width direction.

* * * * *